US005548910A

United States Patent [19]

Klingseis

[11] Patent Number: 5,548,910

[45] Date of Patent: Aug. 27, 1996

[54] SPIKE GUARD FOR GOLF SHOES

[76] Inventor: James E. Klingseis, 26271 Via De Gavilan, San Juan Capistrano, Calif. 92675

[21] Appl. No.: 354,223

[22] Filed: Dec. 12, 1994

[51] Int. Cl.[6] ..... A43B 5/00; A43B 1/10

[52] U.S. Cl. ..... 36/135; 36/7.3

[58] Field of Search ..... 36/7.3, 7.5, 135, 36/127, 7.1 R

[56] References Cited

U.S. PATENT DOCUMENTS

| | | | |
|---|---|---|---|
| D. 321,086 | 10/1991 | Klingseis et al. | D2/264 |
| 2,958,963 | 11/1960 | Lougheed | 36/7.5 |
| 3,020,654 | 2/1962 | McCann | 36/135 X |
| 3,486,248 | 12/1969 | Olson et al. | 36/7.3 |
| 3,858,336 | 1/1975 | Brown | 36/135 |
| 4,872,273 | 10/1989 | Smeed | 36/135 |
| 5,315,767 | 5/1994 | Bradbury | 36/7.3 X |

FOREIGN PATENT DOCUMENTS

| | | | |
|---|---|---|---|
| 1195053 | 11/1959 | France . | |
| 157698 | 1/1921 | United Kingdom | 36/7.3 |

OTHER PUBLICATIONS

Brochure entitled fore—dated Jan./Feb. 1989—p. 38—showing Sole-In-One—Wear your golf shoes Anywhere! ad.

Copy of ad from a catalog by Hammacher Schlemmer—Christmas Delivered in a Twinkle (1994 catalog) showing p. 77—Athlete's Massaging Sandals.

Copy—Article from newspaper Times Advocate dated Oct. 21, 1994 under Innovative Idea heading. Article entitled "Vista Man Hits Green With Cover For Cleats".

Copy—Article from newspaper Times Advocate dated Jan. 18, 1995 under First Run heading. Article entitled "Spike-Mate shoe covers may just take off running".

*Primary Examiner*—B. Dayoan
*Attorney, Agent, or Firm*—Henderson & Sturm

[57] ABSTRACT

A spike guard for spiked shoes, such as golf shoes, including an elastomeric body having a top portion, bottom portion, a front end and a rear end. A plurality of spaced apart elastomeric projections extend upwardly from the top portion of the elastomeric body for universally receiving the spikes of a spiked shoe. Devices are also provided for holding the elastomeric body onto a spiked shoe so that the spikes of the shoe will not damage the surface disposed thereunder.

3 Claims, 1 Drawing Sheet

SPIKE GUARD FOR GOLF SHOES

TECHNICAL FIELD

The present invention relates generally to a spike guard for spiked shoes, and more particularly to such a device for use with golf shoes having spikes thereon.

1. Background Art

Golf shoes have been worn for many decades by golfers to prevent slipping during the execution of golf shots and to aid in traction in walking from place to place. One of the problems associated with the use of golf shoes is that they tend to damage or tear up the greens when walking thereon. This is especially true by people who do not pick up their feet adequately or for some reason accidentally drag their foot. Similarly, golf shoes can easily tear up the carpet in a pro shop of a golf course.

Golfers typically leave home with other shoes on and then change into their golf shoes on arrival at the golf course. If they did otherwise, they could possibly damage areas in their own home or damage the cars or other vehicles in which they travel.

Consequently, there is a need for a solution to the aforementioned problems.

2. Disclosure of the Invention

The present invention relates generally to a spike guard for spiked shoes, such as golf shoes, including an elastomeric body having a top portion, a bottom portion, a front end and a rear end. A plurality of spaced apart elastomeric projections extend upwardly from the top portion of the elastomeric body for universally receiving the spikes of a spiked shoe, the sole and heel of the shoe being disposed directly above and in contact with the top portion of the elastomeric projections. Devices are also provided for holding the elastomeric body onto a spiked shoe so that the spikes of the shoe will not damage the surface disposed thereunder.

An object of the present invention is to provide a spike guard for use while putting on golf greens to prevent the tearing up of such greens.

Another object of the present invention is to provide a spike guard so that a person can leave home wearing golf shoes and prevent damage to a car, a pro shop and to the golf course greens themselves upon arrival and while playing golf on the putting greens.

Other objects, advantages, and novel features of the present invention will become apparent from the following detailed description of the invention when considered in conjunction with the accompanying drawings.

BEST MODE FOR CARRYING OUT THE INVENTION

Figure 1:
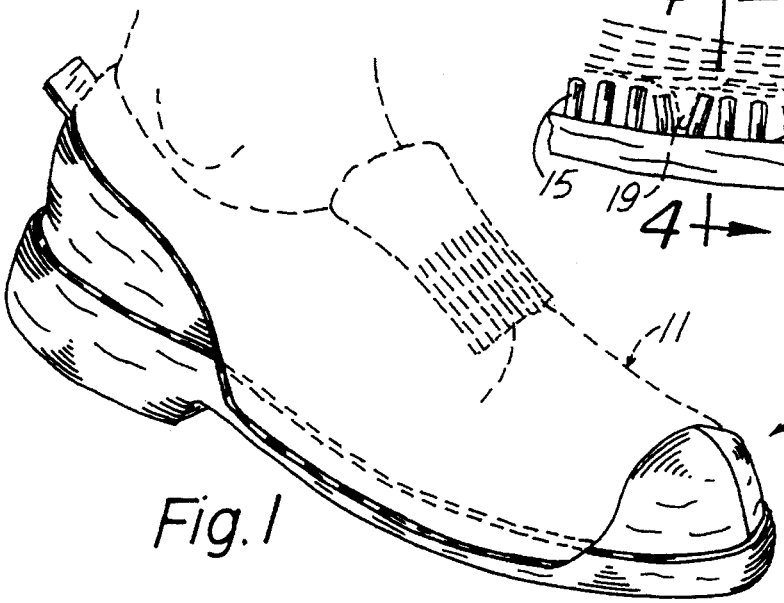
FIG. 1 is a perspective view of preferred embodiment of a spike guard shown on a golf shoe.
Figure 3:
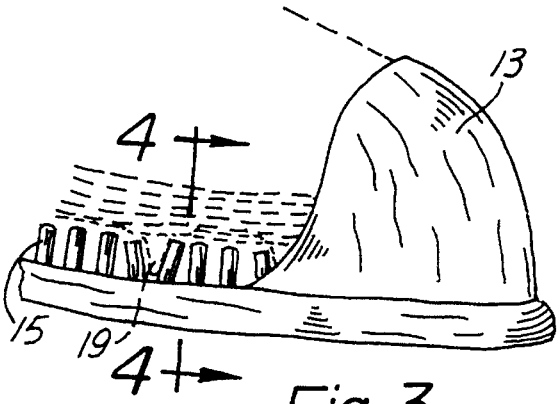
FIG. 3 is an enlarged, partial side view of the preferred embodiment showing how the spikes of a golf shoe extend between the upstanding elastomeric projections.
Figure 4:
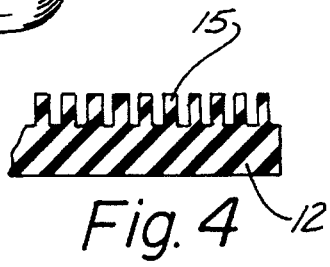
FIG. 4 is a cross sectional view taken along line 4—4 of FIG. 3.

Referring now to the drawings wherein like reference numerals designate identical or corresponding parts throughout the several views, FIG. 1 shows a spike guard (10) constructed of an elastomeric material similar to the material that "rubbers" are made from which protect shoes from wet and damp conditions. Similarly, the spike guard (10) can be easily pulled over a golf shoe (11) in the manner shown in FIGS. 1 and 2 as is well known for the devices to protect simply for waterproofing a shoe and shielding from the elements.

Figure 2:
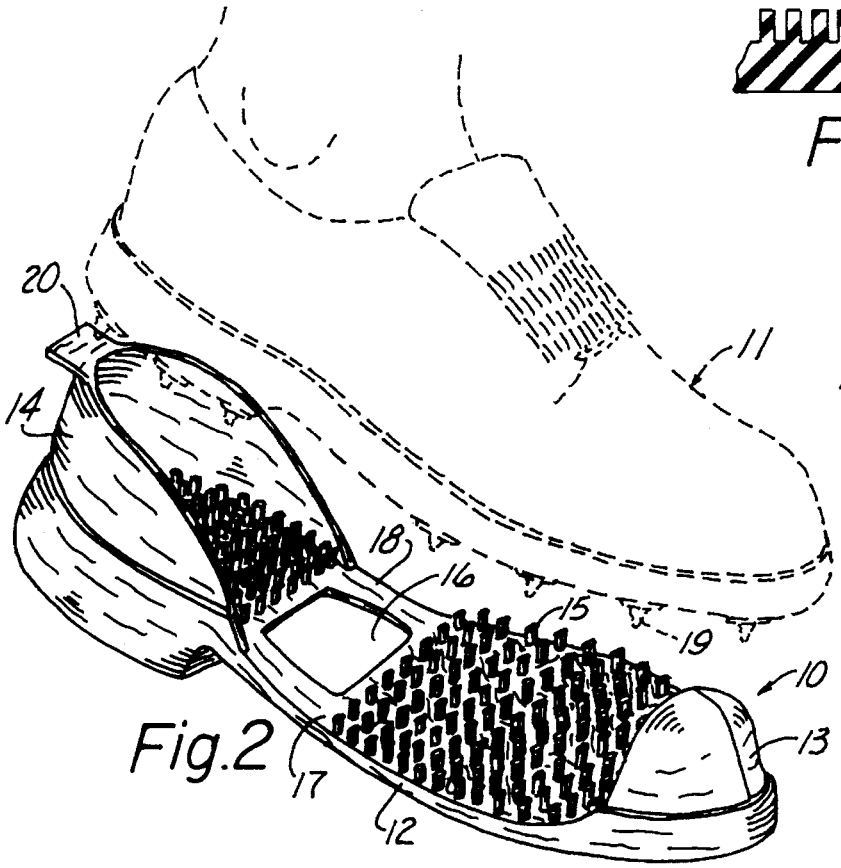
FIG. 2 is a perspective view like FIG. 1 but showing the golf shoe removed to show elastomeric projections for receiving the spikes of golf shoes.
Figure 5:
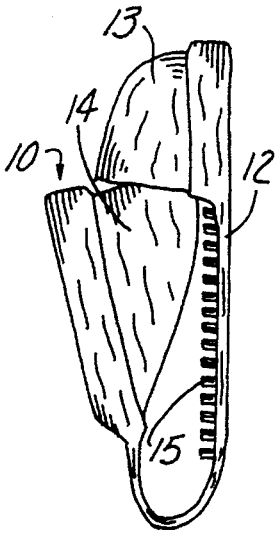
FIG. 5 shows how the spike guard of the present invention can be easily folded for storage and for transporting it from place to place.

Referring to FIG. 2, it is noted that a body portion (12) has a top and a bottom and the from portion of the spike guard (10) has a flexible toe section (13) for receiving the toe of the golf shoe (11) and a flexible rear section (14) for receiving the heel of the golf shoe (11).

Upstanding elastomeric projections (15) are molded directly into the body of the spike guard (10); in fact, it is contemplated that the entire spike guard (10) would be molded in one piece out of a rubber-like material, such as elastomeric plastic. Also, a cut-out portion (16) is provided for making the spike guard more universally usable such that the connecting sections (17) and (18) can be stretched to accommodate a large range of sizes of shoes. By adjusting the size and width of the portions (17) and (18), the amount of tension between the toe (13) and heel (14) of the spike guard can be adjusted in its manufacturing process. This, of course, is related to the size of the opening (16) which can be made bigger or smaller to correspondingly adjust the size and therefore the tension strength of strips (17) and (18).

The top of the rear section of the spike guard (14) has a tab (20) which is long enough to be easily grasped with one hand to aid in putting on the spike guard so that the toe of the shoe (11) can first be put into the toe portion (13) of the spike guard and then the rear tab (16) can be pulled to stretch sections (17) and (18). The tab (20) can then be gently released so that section (14) tightly extends over the rear of the shoe (11).

Accordingly it will be appreciated that the embodiment shown herein does indeed accomplish all of the aforementioned objects. By having the spikes (19) of the shoe extend between any one of the elastomeric projections (15), the rest of the elastomeric projection will support the rest of the shoe and of course be universal because it does not matter where the spikes (19) extend down between the elastomeric projections (15). Obviously many modifications and variations of the present invention are possible in light of the above teachings. It is therefore to be understood that, within the scope of the appended claims, the invention may be practiced otherwise than as specifically described.

I claim:

1. A spike guard for shoes having spikes, said spike guard comprising:

an elastomeric body having a top surface, a bottom surface, a front portion including a front end, a rear portion including a rear end and a thickness;

a plurality of discretely arranged and spaced apart finger-like elastomeric projections extending upwardly from said top surface of the elastomeric body for universally receiving the spikes of a shoe disposed directly above said top surface;

a rear elastomeric wall extending upwardly from said rear end of the top surface of said elastomeric body for receiving the rear end of a spiked shoe and a front elastomeric wall extending upwardly from said front end of the top surface of said elastomeric body for receiving the toe portion of a spiked shoe; and wherein the elastomeric body has an inner contoured side portion and an outer contoured side portion and wherein said elastomeric projections are disposed between and above the inner and outer contoured side portions and said inner and outer contoured side portions are disposed rearwardly of the front elastomeric wall.

2. The spike guard of claim 1 including a tab attached to a top portion of the rear elastomeric wall so that a user can pull thereon to stretch the spike guard over a spiked shoe.

3. The spike guard of claim 2 wherein said tab extends rearwardly from said rear elastomeric wall.

* * * * *